United States Patent [19]

Ma

[11] Patent Number: 4,730,988

[45] Date of Patent: Mar. 15, 1988

[54] OIL FOAM ENHANCING AND TURBULENCE REDUCING APPARATUS IN A COMPRESSOR

[75] Inventor: Wei-Ming W. Ma, Williamsville, N.Y.

[73] Assignee: American Standard Inc., New York, N.Y.

[21] Appl. No.: 927,619

[22] Filed: Nov. 6, 1986

[51] Int. Cl.[4] ..... F04B 39/00; F04B 39/02

[52] U.S. Cl. ..... 417/313; 417/372; 417/902; 184/6.16; 184/6.18; 62/469

[58] Field of Search ..... 417/372, 368, 415, 902, 417/312, 313; 184/6.16, 6.18, 6.23; 62/469; 418/88, 94

[56] References Cited

U.S. PATENT DOCUMENTS

| | | | |
|---|---|---|---|
| 2,066,177 | 12/1936 | Johnson | 184/6.16 |
| 2,130,276 | 9/1938 | Hornaday | 417/419 |
| 2,738,919 | 3/1956 | Rusch et al. | 417/372 |
| 2,905,510 | 9/1959 | Gardiner | 418/88 X |
| 2,990,111 | 6/1961 | Bohn | 417/902 X |
| 3,147,914 | 9/1964 | Hatten et al. | 417/415 |
| 3,480,205 | 11/1967 | Hatten | 417/363 |
| 3,614,384 | 10/1971 | Heitchue, Sr. | 417/312 |
| 3,664,771 | 5/1972 | Suzuki et al. | 417/902 X |
| 4,063,853 | 12/1977 | De Groat | 417/53 |
| 4,127,994 | 12/1978 | Niven | 62/469 |
| 4,545,743 | 10/1985 | Earley | 417/372 |
| 4,565,503 | 1/1986 | Wise | 417/372 |
| 4,569,639 | 2/1986 | Hannibal et al. | 417/368 |

FOREIGN PATENT DOCUMENTS

| | | | |
|---|---|---|---|
| 237182 | 11/1985 | Japan | 417/368 |
| 681210 | 8/1979 | U.S.S.R. | 417/313 |

*Primary Examiner*—Carlton R. Croyle
*Assistant Examiner*—Paul F. Neils
*Attorney, Agent, or Firm*—William J. Beres; David L. Polsley; Robert J. Harter

[57] ABSTRACT

A cup-like device, called a deturbulator, having a solid base portion and vertically oriented finger-like elements extending therefrom is disposed in the oil sump of a refrigeration compressor so that the base portion is spaced from the bottom of the oil sump. The compressor has a mechanical stirrer which is driven through the sump oil when the compressor is in operation to purposefully agitate the oil in order to create a sound attenuating blanket of foam within the compressor shell. The stirrer is disposed interior of the deturbulator so that the turbulence created by the stirrer in the oil agitation process is localized and contained within the interior of the deturbulator. The bottom of the oil sump, wherein debris normally collects, is therefore shielded from turbulence which would otherwise tend to stir the debris into the oil. The finger-like elements of the deturbulator both act to break up any wave action in the sump oil and to facilitate the production of foam to quiet the compressor.

17 Claims, 2 Drawing Figures

OIL FOAM ENHANCING AND TURBULENCE REDUCING APPARATUS IN A COMPRESSOR

DESCRIPTION

FIELD OF THE INVENTION

The present invention relates to both the reduction of noise emanating from the shell of a hermetic motor-compressor unit and to the prevention of turbulence in the lower portion of the oil sump, at the bottom of the shell, which might cause debris at the sump bottom to be mixed into the oil.

More particularly, the present invention relates to noise suppression schemes in refrigeration compressors wherein compressor sump oil is mechanically agitated in order to create a sound attenuating foam on the surface of the oil.

BACKGROUND OF THE INVENTION

The use of mechanical stirrers to foam sump oil in refrigeration compressors for noise suppression purposes is old but remains a very viable and popular method of compressor noise attenuation. Typical in this regard are the mechanical stirrers of U.S. Pat. Nos. 2,990,111; 3,480,205; 4,127,994; and 4,545,743. As is noted in U.S. Pat. No. 4,063,853, however, one disadvantage which accompanies the agitation or stirring of the oil in a compressor sump is that contaminants and particles of debris, normally found at the bottom of the oil sump, can be stirred into the oil and can find their way into the bearings of the motor-compressor unit if not otherwise prevented from doing so. This, of course, reduces bearing life in the motor-compressor unit and can lead to a catastrophic failure of it.

Further, it has been specifically recognized that mechanical agitation of compressor sump oil can result in the generation of waves within the sump oil that create a disturbing sloshing noise which emanates from the shell. That is, the very means by which noise suppression is sought to be achieved in some compressors can create a discrete and equally disturbing compressor noise problem. This problem is addressed in U.S. Pat. No. 3,480,205 to Hatten in which a series of baffles are arranged in the oil sump of a compressor to break up such waves to reduce or eliminate the sloshing noise which would otherwise result. The baffles of the Hatten patent are concentric rings disposed around the mechanical stirrer. The bottom of the compressor shell, which is also the bottom of the oil sump therein, is nonetheless fully exposed in Hatten to the stirrer and the turbulence created by it in the oil agitation process.

There exists a need for apparatus in a refrigeration compressor which allows for and promotes the agitation and foaming of sump oil for noise attenuation purposes while preventing the mixing of debris found at the bottom of the oil sump into the compressor oil supply.

SUMMARY OF THE PRESENT INVENTION

It is the primary object of the present invention to provide apparatus which facilitates the foaming of sump oil in a refrigeration compressor for noise attenuation purposes while preventing the mixing, as a result of the oil agitation process, of debris into the compressor oil supply.

The primary object of the present invention, as well as others which will become apparent after consideration of the specification and claims which follow, is accomplished by a cup-like device, disposed in the oil sump of a refrigeration compressor, which surrounds the mechanical stirrer by which sump oil is agitated and foamed. The apparatus, called a "deturbulator", includes a generally horizontal solid base section which is positioned above the bottom of the oil sump in the compressor shell but below the stirring element. Vertical, finger-like projections extend upward through the oil in the sump from the deturbulator base section to the nominal level of oil in the compressor sump.

In operation the mechanical stirrer foams sump oil by agitating it. The foaming process is enhanced by the existence of the deturbulator and its finger-like projections through which oil flows under the impetus of the stirrer. While the finger-like projections operate to enhance oil foaming, they also operate to break up any wave action in the sump oil created by the agitation process. Unwanted sloshing noise within the compressor shell is therefore prevented. Further, the solid base portion of the deturbulator shields the bottom of the oil sump, wherein debris tends to settle, from the agitation process and the turbulence which results therefrom so that debris does not tend to be mixed into the oil from where it can eventually find its way to motor-compressor bearing locations.

DESCRIPTION OF THE PREFERRED EMBODIMENT

Figure 1:
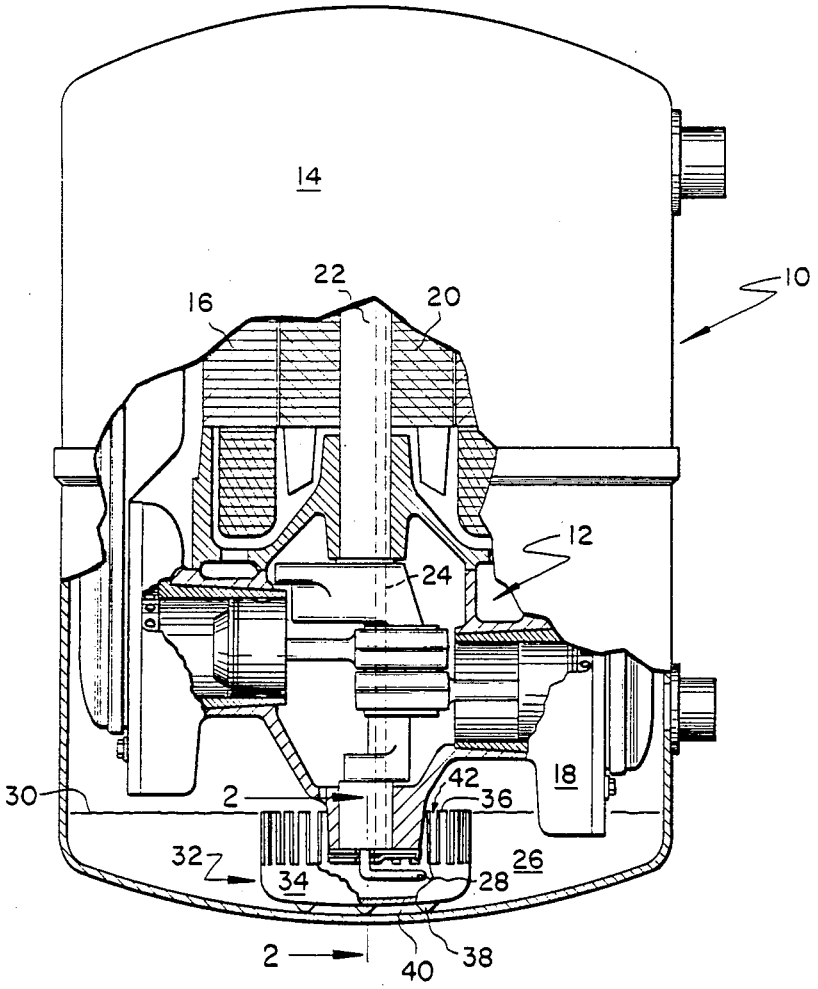
FIG. 1 is a view of a reciprocating hermetic refrigeration motor-compressor unit in which the deturbulator of the present invention is employed.

Illustrated in FIG. 1 is a typical low-side reciprocating hermetic refrigeration motor-compressor unit 10 wherein a motor-compressor 12 is disposed interior of a shell 14. Motor-compressor 12 is comprised generally of a motor section 16 and a compressor section 18. Motor 16 includes a rotor 20, the rotation of which in operation drives a crankshaft 22.

As is typical in such motor-compressor units, several locations exist which require lubrication. For lubrication purposes an oil groove 24 is provided in crankshaft 22 which provides a flow path for the delivery of oil picked up from oil sump 26, at the bottom of the crankshaft, to the locations at which it is required in the motor-compressor unit. It will be noted that in a low-side refrigeration compressor some refrigerant will typically be mixed with the oil in sump 26 since the refrigerant which is returned to the compressor for recompression essentially dumps into the interior of the shell prior to being delivered to the cylinders of the compressor.

Disposed on the bottom of crankshaft 22 is a mechanical stirrer 28. The bottom of crankshaft 22 and mechanical stirrer 28 are immersed in the oil in sump 26 which is nominally at a level indicated by line 30. Therefore, when crankshaft 22 is driven by the rotation of rotor 20, stirrer 28 is caused to rotate within the oil in sump 26 at high speed. The high speed rotation of stirrer 28 causes oil in the sump to be foamed. A sound attenuating blanket of bubbles is thus created internal of the compressor shell which effectively blankets motor-compressor 12.

Figure 2:
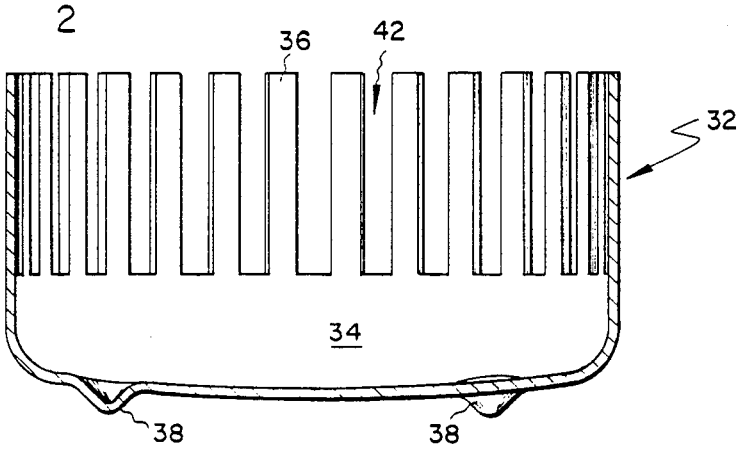
FIG. 2 is a cross-sectional view of the deturbulator of the present invention.

In order to shield the bottom of the compressor shell from turbulence, to enhance oil foaming and to prevent the sloshing of compressor oil, a deturbulator 32 is mounted in the oil sump in shell 14. Referring to both FIGS. 1 and 2, deturbulator 32 is a cup-like device having a solid base portion 34 from which vertically oriented spaced apart finger-like elements 36 extend. Base portion 34 is comprised of a generally horizontal/-flat bottom and a solid rim which extends in a generally vertical fashion upward from the periphery thereof. Deturbulator 32 also includes feet 38 which rest upon the bottom of shell 14 and which extend downward from the bottom of the base portion 34.

Deturbulator 32 is preferably mounted in shell 14 so that stirrer 28 is disposed within the rim of base portion 34. Finger-like elements 36 extend upward from the rim of base portion 34 to the nominal level of oil in the sump. A space 40 is created between the bottom of deturbulator base portion 34 and the bottom of the compressor shell. The deturbulator, which is preferably fabricated from a thin gauge metal but which could also be fabricated from a material such as plastic, can be mounted within compressor shell 14 in any one of many ways but will preferably be welded to the bottom thereof. If deturbulator 32 is fabricated from otber than a metal, a deturbulator mounting arrangement other than one which includes welding would of course be required.

When motor-compressor unit 10 is shut down, oil drains from the motor-compressor within shell 14 and off of the inner shell wall into sump 26. Such oil, as earlier mentioned, is generally mixed with some of the refrigerant which is delivered during motor-compressor operation into the interior of shell 14. Any contaminants or debris in the oil will tend to settle at the bottom of shell 14 in the space 40 which is created between the base portion of deturbulator 32 and the bottom of the shell.

Upon start-up of the compressor crankshaft 22 commences to rotate at high speed thereby driving stirrer 28 through the oil-refrigerant mixture in sump 26. The driving of stirrer 28 creates turbulence and bubbles within the mixture. The bubbles rise through the oil and coalesce to form a sound attenuating blanket of oil-refrigerant foam on the surface of the oil which envelops the motor-compressor unit within the shell.

The turbulence created by stirrer 28 originates interior of deturbulator 32 and, primarily, in base portion 34 thereof. Such turbulence is localized by the deturbulator, which contains the turbulence in its interior, with the result that the flow of oil which does occur exterior of the deturbulator in the sump is generally nonturbulent. Therefore, a relatively undisturbed layer of oil will be found to exist at the bottom of sump 26 in the area of space 40 which is overlain by the deturbulator base portion even when stirrer 28 is agitating the sump oil at a different yet proximate location. Because the oil in space 40 remains essentially undisturbed, any debris therein will also remain undisturbed. Further, in order to be delivered to motor-compressor bearing locations any such debris is physically required to enter the interior of the deturbulator. To do so, such debris must pass over or between finger-like elements 36. Therefore, the likelihood that such debris will find its way to the bearing surfaces of the motor-compressor unit is very significantly diminished.

Finger-like elements 36 break up any waves formed in the oil in sump 26, act as a barrier to the entry of debris into the vicinity of the oil pickup location at the bottom of the crankshaft and promote the production of foam at the surface of the oil in sump 26 when motor-compressor unit 10 is in operation while simultaneously permitting the free flow of oil into and out of the interior of the deturbulator. The elements 36 extend to the nominal level of oil in sump 26 when the motor-compressor unit is shut down. When the motor-compressor unit is in operation the level of the oil in sump 26 will be somewhat reduced as oil is delivered from the sump to other motor-compressor unit locations for lubrication and cooling purposes. The action of stirrer 28, while of itself causing the sump oil to foam, will also force oil through the spaces 42 between finger-like elements 36 which enhances the oil foaming process. The level of oil in sump 26 will always be such, however, that stirrer 26 and the bottom of crankshaft 22, where oil is picked up for flow into groove 24, will be immersed in oil in the liquid state.

While deturbulator 32 has been described and illustrated in the context of a low-side reciprocating compressor it should be apparent that the deturbulator of the present invention has application in any type of compressor or machine having an oil sump in which debris might accumulate and wherein the bottom of the sump is to be shielded from turbulence.

What is claimed is:

1. Noise suppression apparatus for a compressor having a sump in which oil collects and in the bottom of which debris settles, comprising:

a mechanical stirrer mounted for movement in the oil sump of the compressor to create turbulence and foam in oil collected therein; and means for locally containing the turbulence created in said oil by the movement of said stirrer while simultaneously enhancing the foaming of said oil for purposes of noise suppression, said containing means being cup-like and including a base portion that is spaced from and overlies the bottom of the oil sump so that debris settling at the bottom of the oil sump beneath said base portion is shielded from the turbulence created by said stirrer.

2. The apparatus according to claim 1 wherein said means for containing turbulence has a solid base portion which overlies the bottom of the oil sump.

3. The apparatus according to claim 2 wherein said means for containing turbulence is a cup-like device mounted in said oil sump so that said stirrer is located in the interior thereof.

4. The apparatus according to claim 3 wherein said means for containing turbulence includes means for enhancing the production of foam in said oil while allowing for the entry and egress of oil from the interior of said cup-like device.

5. The apparatus according to claim 4 wherein said means for enhancing comprises spaced apart finger-like elements extending upward from said solid base portion.

6. The apparatus according to claim 5 wherein said base portion includes a generally horizontal flat bottom and a generally vertical rim extending upward from said horizontal bottom, said finger-like elements extending upward from said rim.

7. The apparatus according to claim 6 wherein said stirrer is located interior of said base portion of said cup-like device.

8. The apparatus according to claim 7 wherein said finger-like elements extend upward to the nominal level of oil in said sump when said compressor is shut down.

9. The apparatus according to claim 7 wherein said cup-like device includes a plurality of feet extending downward from said base portion, said feet for mounting said device to the shell of said compressor.

10. A hermatic refrigeration compressor comprising:

a shell defining a sump in which oil collects, said oil sump having a bottom;

motor-compressor disposed in said shell and having a crankshaft extending into said oil sump;

a mechanical stirrer attached to the portion of said crankshaft extending into said sump, said stirrer inducing turbulence and foaming oil collected in said sump in response to crankshaft motion; and cup-like means, cooperating with said stirrer, for enhancing the foaming in the oil in said sump and for shielding the bottom of said oil sump from the turbulence created in the sump oil by the movement of said stirrer therethrough, said cup-like means including a base portion which overlies and is spaced apart from the bottom of said oil sump where debris tends to settle.

11. The compressor according to claim 10 wherein said means for shielding is a cup-like device mounted in said compressor so that said stirrer resides in the interior thereof.

12. The compressor according to claim 11 wherein said cup-like device has a solid base portion which overlies the bottom of said sump.

13. The compressor according to claim 12 wherein said cup-like device has a plurality of spaced apart finger-like elements extending upward from said solid base portion, said finger-like elements permitting the entry and egress of oil from the interior of said device under the impetus of said stirrer and thereby encouraging the production of oil foam in said shell.

14. The compressor according to claim 13 wherein said base portion includes a generally vertically extending rim disposed about the periphery of the portion of said base portion which overlies said sump bottom, said finger-like elements extending upward from said rim to the nominal level of oil in said sump when said compressor is shut down and said stirrer being surrounded by said rim.

15. Apparatus, in a compressor having an oil sump where the oil sump has a bottom which defines a debris settling area, for shielding the debris settling area at the bottom of the oil sump from turbulence in the sump oil comprising:

a solid base portion including a solid, generally planar horizontal bottom portion and a solid rim extending vertically from the periphery of said horizontal bottom;

a plurality of spaced apart finger-like elements extending from said rim portion of said base portion; and means for mounting said apparatus in the oil sump of a the compressor so that said solid base portion overlies the debris settling area defined at the bottom of said oil sump.

16. The apparatus according to claim 15 wherein the length of said finger-like elements is predetermined so that when said apparatus is mounted in a compressor said fingers extend upward to the nominal level of oil in said oil sump when said compressor is shut down.

17. The apparatus according to claim 16 wherein said means for mounting comprises a plurality of feet extending from the base portion of said apparatus.

* * * * *

UNITED STATES PATENT AND TRADEMARK OFFICE

CERTIFICATE OF CORRECTION

PATENT NO. : 4,730,988

DATED : March 15, 1988

INVENTOR(S) : Wei-Ming W. Ma

It is certified that error appears in the above-identified patent and that said Letters Patent is hereby corrected as shown below:

In The Claims:

Claim 10, Column 5, line 6, before "motor-compressor" insert --a--.

Signed and Sealed this

Sixteenth Day of August, 1988

*Attest:*

DONALD J. QUIGG

*Attesting Officer*

*Commissioner of Patents and Trademarks*